US008049087B1

(12) United States Patent
Opatik

(10) Patent No.: US 8,049,087 B1
(45) Date of Patent: Nov. 1, 2011

(54) GUITAR BODY AND METHOD OF MANUFACTURE

(76) Inventor: Greg Opatik, Grandville, MI (US)

( * ) Notice: Subject to any disclaimer, the term of this patent is extended or adjusted under 35 U.S.C. 154(b) by 0 days.

(21) Appl. No.: 12/786,586

(22) Filed: May 25, 2010

Related U.S. Application Data

(60) Provisional application No. 61/181,115, filed on May 26, 2009.

(51) Int. Cl.
*G10D 1/08* (2006.01)

(52) U.S. Cl. ..... 84/267

(58) Field of Classification Search ..... 84/267, 84/290–293
See application file for complete search history.

(56) References Cited

U.S. PATENT DOCUMENTS

2005/0022650 A1* 2/2005 Untermyer et al. ..... 84/291

OTHER PUBLICATIONS

FenderProducts, p. 1 of 2; http://www.fender.com/products/search.php?section=guitars.
Gibson Guitar: Electric, Acoustic and Bass Guitars, Baldwin Pianos, p. 1 of 1; http://www2.gibson.com/Products/Electric-Guitars.aspx.

* cited by examiner

*Primary Examiner* — Kimberly Lockett
(74) *Attorney, Agent, or Firm* — McGarry Bair PC

(57) ABSTRACT

The invention relates to a guitar body comprising an upper bout region and a lower bout region with a waist region disposed there between. A first and second peripheral edge of the guitar body is defined in a longitudinal direction thereof by a first and second upper bout region, a first and second waist region, and a first and second lower bout region, respectively. An anterior face and a posterior face of the guitar body extend between the first and second peripheral edges. At least one of the anterior face and the posterior face includes at least one curve so that at least a portion of the first peripheral edge includes at least one curve so that at least a portion of the first peripheral edge of the guitar body is not co-planar with at least a portion of the second peripheral edge of the guitar body.

32 Claims, 13 Drawing Sheets

GUITAR BODY AND METHOD OF MANUFACTURE

CROSS REFERENCE TO RELATED APPLICATIONS

This application claims the benefit of U.S. Provisional Patent Application No. 61/181,115, filed May 26, 2009, which is incorporated herein by reference in its entirety.

BACKGROUND OF THE INVENTION

1. Background

The invention generally relates to the field of guitar bodies for use in electric guitars and a method of manufacturing guitar bodies.

2. Description of the Related Art

The design of a guitar, such as an electric guitar, includes both an ornamental aspect and a functional aspect. Typically, electric guitars have a solid body made from a flat plank or board of wood. The perimeter of the body can be machined to have a variety of shapes to provide the guitar with the desired aesthetics and features necessary for coupling with the functional elements of the guitar such as the neck, strings, bridge, pickup coils, selector switches, etc. Typical solid body guitars can be very heavy and shaping of the body for comfort and ease of use can be limited by the thickness of the wood. In addition, the design aesthetics of solid body guitars are typically limited to the two-dimensional cut-out shape of the guitar body.

BRIEF DESCRIPTION OF THE INVENTION

According to one embodiment of the invention, a guitar body comprises an upper bout region and a lower bout region with a waist region disposed between the upper and lower bout regions. A first peripheral edge of the guitar body is defined generally in a longitudinal direction thereof by a first upper bout region, a first waist region, and a first lower bout region. A second peripheral edge of the guitar body is defined generally in the longitudinal direction thereof by a second upper bout region, a second waist region, and a second lower bout region. An anterior face and a posterior face of the guitar body extend between the first and second peripheral edges thereof. At least one of the anterior face and the posterior face includes at least one curve so that at least a portion of the first peripheral edge includes at least one curve so that at least a portion of the first peripheral edge of the guitar body is not co-planar with at least a portion of the second peripheral edge of the guitar body.

According to another embodiment, the first upper bout region and the first lower bout region are disposed posteriorly of the first waist region thereby creating a recessed area on the posterior face of the guitar body. The anterior face curves generally parallel with the recessed area of the posterior face of the guitar body. The first peripheral edge is disposed posteriorly of the second peripheral edge of the guitar body.

According to another embodiment, the anterior face slopes toward the first peripheral edge adjacent thereto.

According to yet another embodiment, the second peripheral edge includes at least one portion that extends laterally and anteriorly with respect to the guitar body.

According to another embodiment, the entire length of the second peripheral edge extends laterally and anteriorly with respect to the guitar body, thereby forming a brake that resists sliding against a surface on which the guitar body is rested.

According to yet another embodiment, the first upper bout region, the first waist region and the first lower bout region cooperate to form a generally U-shaped region on the posterior face of the guitar body. The second upper bout region, the second waist region and the second lower bout region cooperate to form a generally U-shaped region on the posterior face of the guitar body.

According to another embodiment, the first upper bout region and the second upper bout region cooperate to form a generally S-shaped region between the posterior and the anterior faces of the guitar body. The first lower bout region and the second lower bout region cooperate to form a generally S-shaped region between the posterior and the anterior faces of the guitar body.

According to another embodiment, the anterior face of the first lower bout portion slopes posteriorly adjacent a longitudinal end thereof.

According to another embodiment, at least a portion of the first peripheral edge is offset posteriorly and at least a portion of the second peripheral edge is offset anteriorly.

According to still another embodiment, the guitar body has a neck attachment region located in the upper bout region adapted to have a guitar neck mounted thereto so that strings can be provided along the neck and the anterior face of the guitar body. The anterior face of the guitar body has a bridge provided thereon. The posterior face of the guitar body has a recessed area adapted to receive electronic equipment therein.

According to another embodiment, the guitar body is made from compression molding of laminated plies of a lightweight wood.

According to another embodiment, a guitar body comprises an upper bout region and a lower bout region with a waist region disposed between the upper and lower bout regions. A first peripheral edge of the guitar body is defined generally in a longitudinal direction thereof by a first upper bout region, a first waist region, and a first lower bout region. A second peripheral edge of the guitar body is defined generally in the longitudinal direction thereof by a second upper bout region, a second waist region, and a second lower bout region. An anterior face and a posterior face of the guitar body extend between the first and second peripheral edges thereof. At least a portion of the first peripheral edge is offset posteriorly and at least a portion of the second peripheral edge is offset anteriorly.

The guitar body and method according to the invention provide a guitar body with unique ornamental and functional features that can improve the look of the guitar and increase a user's enjoyment and comfort level, especially during long periods of play. The 3-dimensional curves of the guitar body provide a unique ornamental appearance in 3-dimensions. The 3-dimensional curves also provide for an improved fit of the guitar body to the curves of a user's body. The method of making the guitar body provides the ability to form the guitar body curves in 3-dimensions and provides a guitar body that is lighter in weight compared to typical solid body guitars.

DESCRIPTION OF AN EMBODIMENT OF THE INVENTION

Figure 1:
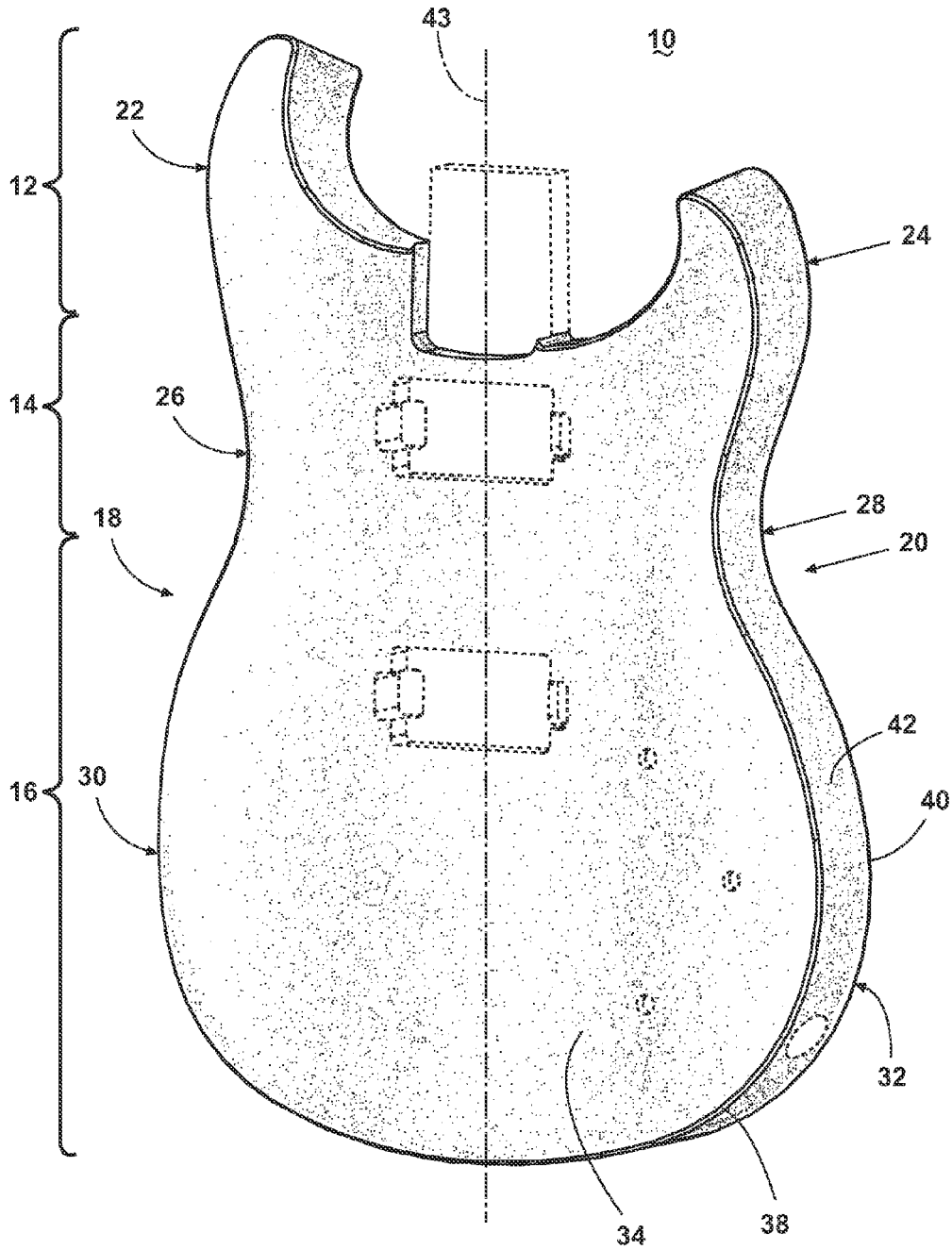
FIG. 1 is a front perspective view of a guitar body according to an embodiment of the invention.
Figure 2:
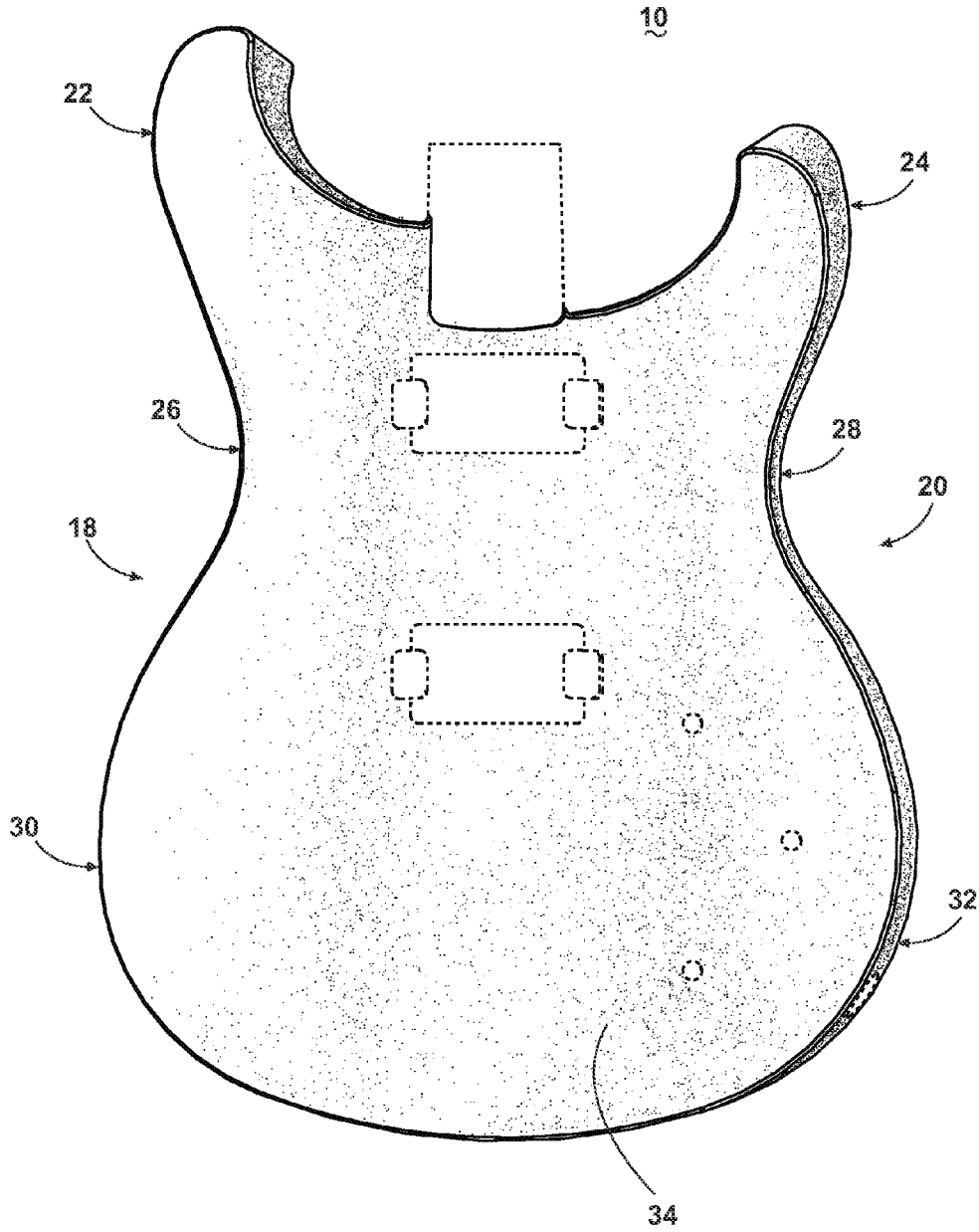
FIG. 2 is a front elevation view of the guitar body of FIG. 1 according to the embodiment of the invention.
Figure 3:
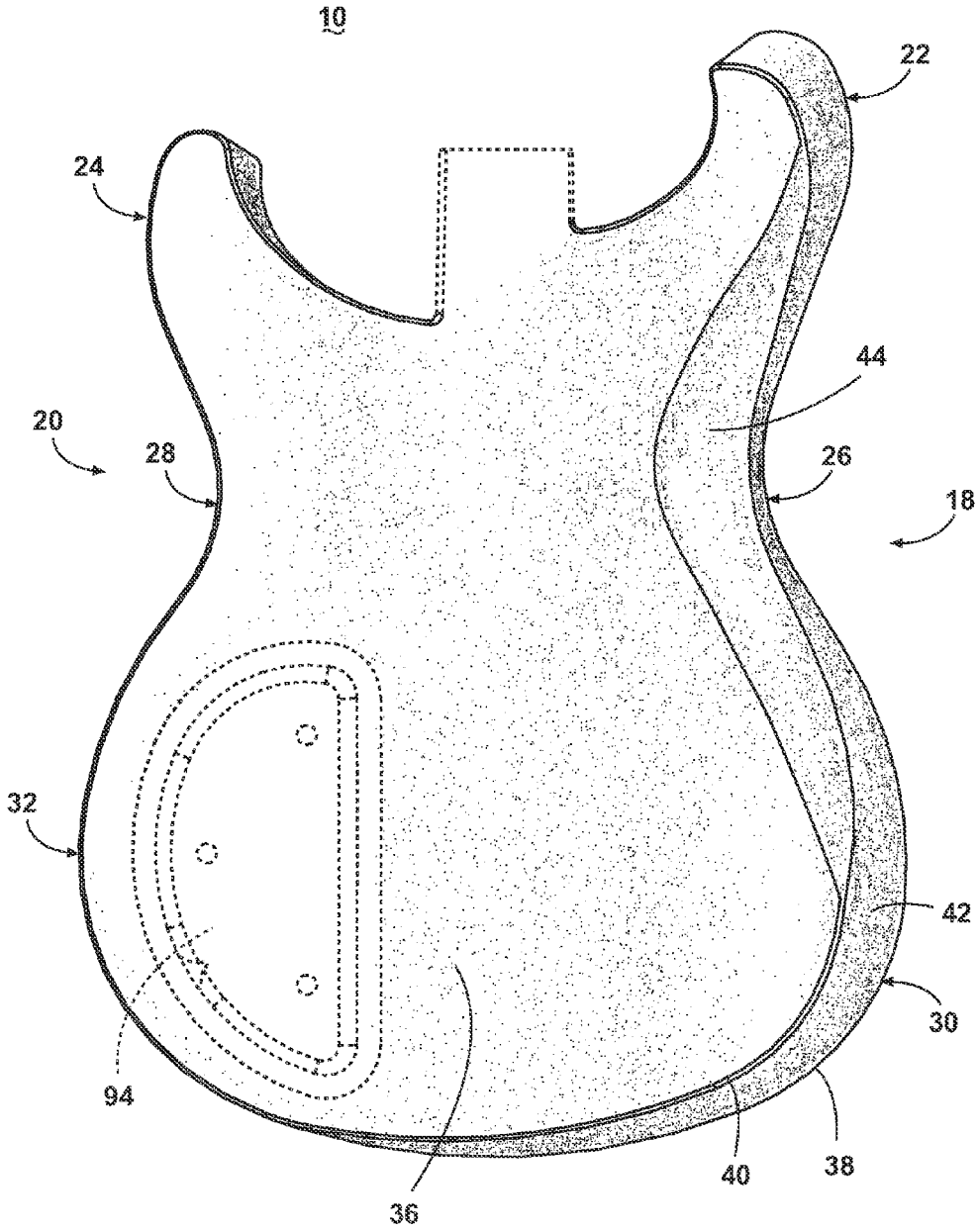
FIG. 3 is a rear elevation view of the guitar body of FIG. 1 according to the embodiment of the invention.

FIGS. 1-8 illustrate the ornamental appearance of a guitar body 10 according to an embodiment of the invention. Referring now to FIGS. 1-3, for the purposes of this description, the guitar body 10 can be considered to comprise three regions along a longitudinal axis of the guitar body 10: an upper bout region 12, a narrowing or waist region 14 and a lower bout region 16. The guitar body 10 can further comprise a first peripheral edge or side 18 and a second peripheral edge or side 20 along a longitudinal axis of the guitar body 10. Along the first side 18, the guitar body 10 can include a first upper bout region 22, a first waist 26 and a first lower bout region 30. Along the second side 20, the guitar body 10 can include a second upper bout region 24, a second waist 28 and a second lower bout region 32. The guitar body 10 can further include a front or anterior face 34 and a rear or posterior face 36 defined along their respective perimeters by a front edge 38 and a rear edge 40, respectively. The front edge 38 and rear edge 40 define a side wall 42.

Figure 4:
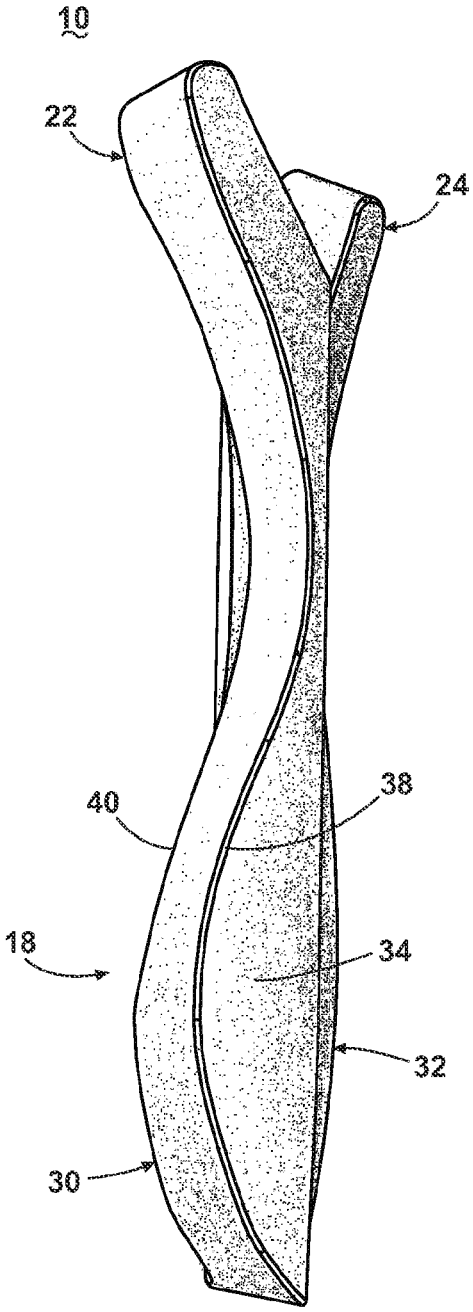
FIG. 4 is a side elevation view of the guitar body of FIG. 1 according to the embodiment of the invention.
Figure 5:
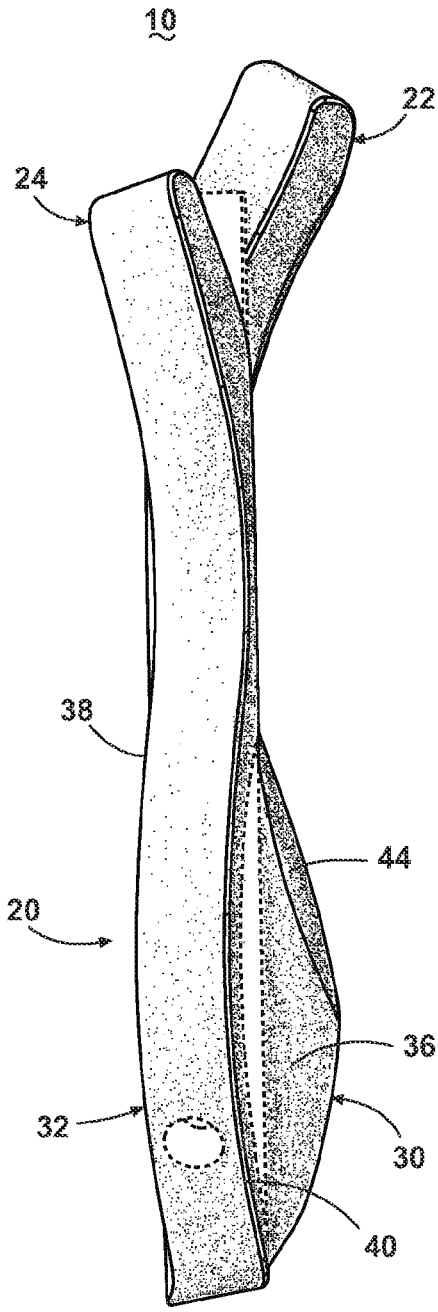
FIG. 5 is a side elevation view of the guitar body of FIG. 1 according to the embodiment of the invention.
Figure 6:
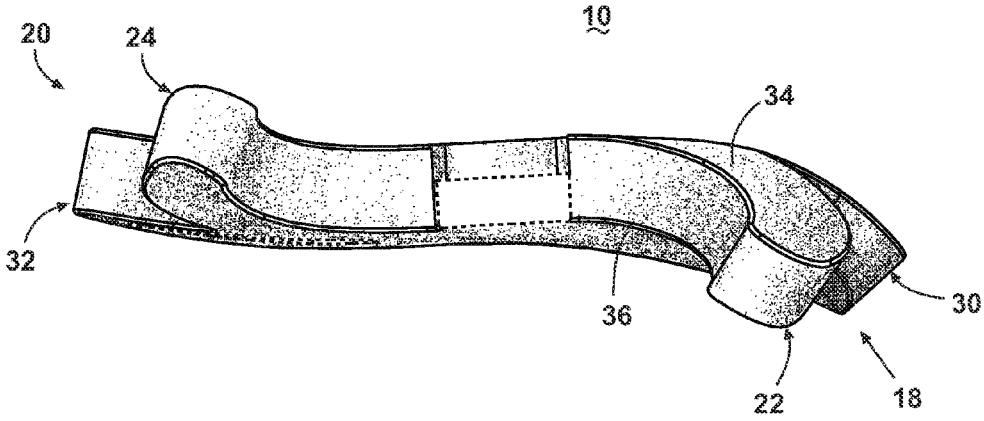
FIG. 6 is an upper end elevation view of the guitar body of FIG. 1 according to the embodiment of the invention.
Figure 7:
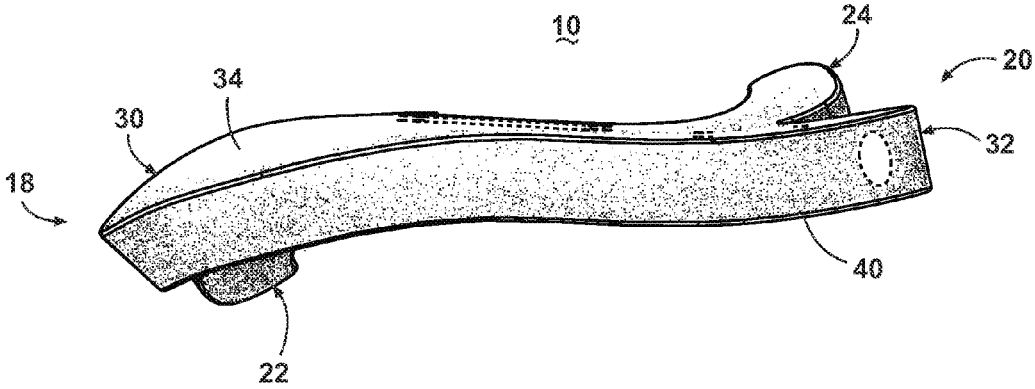
FIG. 7 is a lower end elevation view of the guitar body of FIG. 1 according to an embodiment of the invention.
Figure 8:
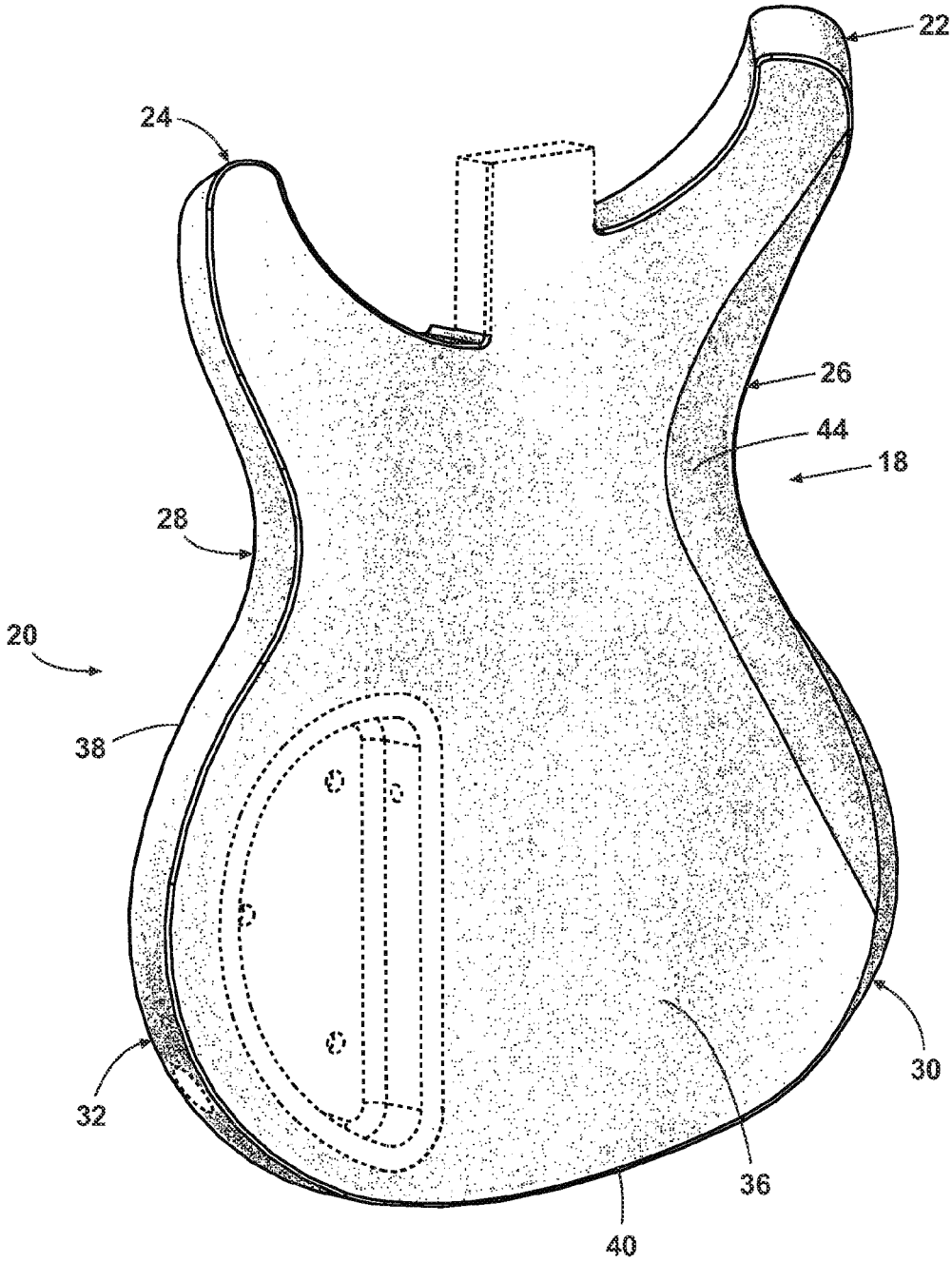
FIG. 8 is a rear perspective view of the guitar body of FIG. 1 according to an embodiment of the invention.

As illustrated in FIGS. 4-7, the first and second sides 18, 20 are in the form of a pair of compound curves that form the shape of the guitar body 10. As best illustrated in FIGS. 4 and 5, the first upper bout region 22 and the first lower bout region 30 cooperate to form a generally U-shaped region on the posterior face 36 of the guitar body 10. Similarly, the second upper bout region 24 and the second lower bout region 32 cooperate to form a generally U-shaped region on the posterior face 36 of the guitar body 10. Referring to FIGS. 6 and 7, the first upper bout region 22 and the second upper bout region 24 and the first lower bout region 30 and the second lower bout region 32, respectively, cooperate to generally form an S-shaped region between the anterior and posterior faces 34 and 36 of the guitar body 10.

Referring now to FIG. 3, the posterior face 36 comprises a curvilinear contour or recessed region 44 along the first side 18 extending from the first upper bout region 22 through the first waist 26 to the first lower bout region 30, with the apex of the contour region 44 generally located in the area of the first waist 26. The first upper bout region 22 and the first lower bout region can be disposed posteriorly of the first waist such that the contour region 44 forms a recessed area on the posterior face of the guitar body. The contour region 44 comprises an area of decreasing slope, smoothly extending from the posterior face 36 into the side wall 42 in the first side 18.

As can best be seen in FIGS. 4-7, the guitar body 10 is not planar along a central anterior plane defined by a central portion of the anterior face 34 generally extending between the upper bout region 12 and the waist region 14 along a central axis 43 of the guitar body 10 (see FIG. 1), but extends laterally or is curved away from the central anterior plane. The first upper bout region 22 and the first lower bout region 30 curve away from the central anterior plane in a posterior direction towards the posterior face 36. The second upper bout region 24 and the second lower bout region 32 curve away from the central anterior plane in an anterior direction towards the anterior face 34. In this manner, at least a portion of the first side 18 is not co-planar with at least a portion of the second side 20. As illustrated in FIGS. 4-7, first side 18 is disposed posteriorly of the second side 20.

The curvilinear shape of the guitar body 10 provides a sidewall 42 that is generally sloped in different directions along the length of the sidewall 42. Along the first side 18, the sidewall 42 generally slopes away from the anterior face 34 towards the posterior face 36. Along the second side 20, the sidewall 42 generally slopes away from posterior face 36 towards the anterior face 34.

While the guitar body 10 is described as being curved away from the frontal plane on both the first and second sides 18, 20, it is within the scope of the invention for the guitar body 10 to only curve away from the frontal plane along one side, either the first side 18 or the second side 20.

The guitar body 10 can further contain any additional features known in the art suitable for a guitar such as one or more pickups, a bridge, a neck, strings, output jacks, strap pins, a whammy bar, knobs and switches, etc. . . . In addition, while the guitar body 10 is illustrated for use as a guitar for a right-handed user, wherein the guitar body 10 is held by the user's right hand, the guitar body 10 can be made suitable for use as a guitar for a left-handed user, to be held by a user's left hand, by creating the mirror image of the guitar body 10 as illustrated in FIGS. 1-8.

The guitar body 10 as illustrated in FIGS. 1-8 not only has unique aesthetic and design features, but also has useful functional features as well.

Figure 9:
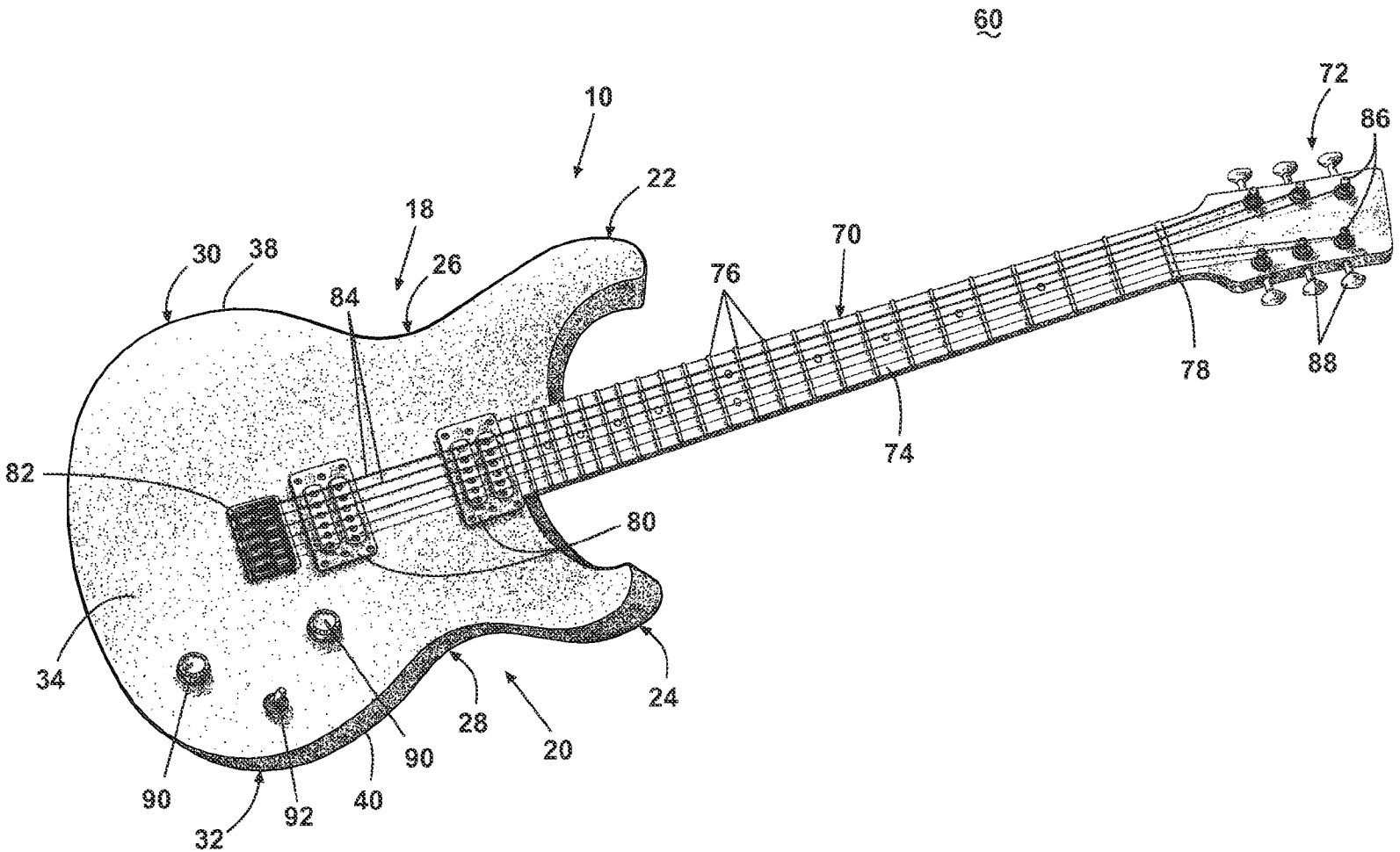
FIG. 9 is a front perspective view of a guitar according to the invention.

FIG. 9 illustrates an example of a guitar 60 using the guitar body 10 as illustrated in FIGS. 1-8 to be held in by the right hand of user while playing, as is known in the art. The guitar 60 can include a neck 70 having a head 72 coupled with the guitar body 10 using mechanical fasteners, such as screws, and/or non-mechanical fasteners, such as an adhesive (not shown), as is known in the art. The neck 70 can be coupled with a fingerboard 74 having a plurality of frets 76. A nut 78 can be located between the head 72 and the fingerboard 74.

The body 10 can include at least two double coil pickups 80. It is also within the scope of the invention for the body 10 to include single coil pickups. The body 10 can further include a bridge 82 for securing a plurality of guitar strings 84. Each string 84 extends from the bridge 82 along the neck 70 to a machine head 86 located on the head 72. A tuner 88 coupled with a machine head 86 can be used to adjust the tension of each string 84.

The body 10 can further include volume and tone controls 90 and a selector switch 92. Although not shown, the body 10 can also contain strap hooks for securing a strap to the body 10. The guitar body 10 can also include an aperture 94 for receiving electronic equipment when the guitar body 10 is used in the form of an electric guitar (see FIG. 3).

The guitar 60 is not limited to the specific elements illustrated in FIG. 9, but can include any number of pickups, strings, switches and controls in any location on the guitar body 10. The length and size of the neck and head and the number and spacing of frets and machine heads can also be of any suitable size and number.

The guitar body 10 can be made from multiple plies of a light weight wood such as a bendy poplar. Each ply of wood can be put through a lamination process of alternating glue and plies of poplar veneer. The product of the lamination process can then be compression molded using induction heat for example to form the 3-dimensional curvilinear shape of the guitar body 10. The molded product can then be shaped using a CNC router to form the guitar body 10. For example, 25 plies of 1.5 mm thick Italian bendy poplar can be used to make the guitar body 10. The guitar body 10 can be made to any desired thickness by modifying the number of plies used to form the body 10. In addition, the curves of the guitar body 10 extending away from the frontal plane of the body 10 and the contour region 44 can be made to suit the needs of the individual user.

Figure 10:
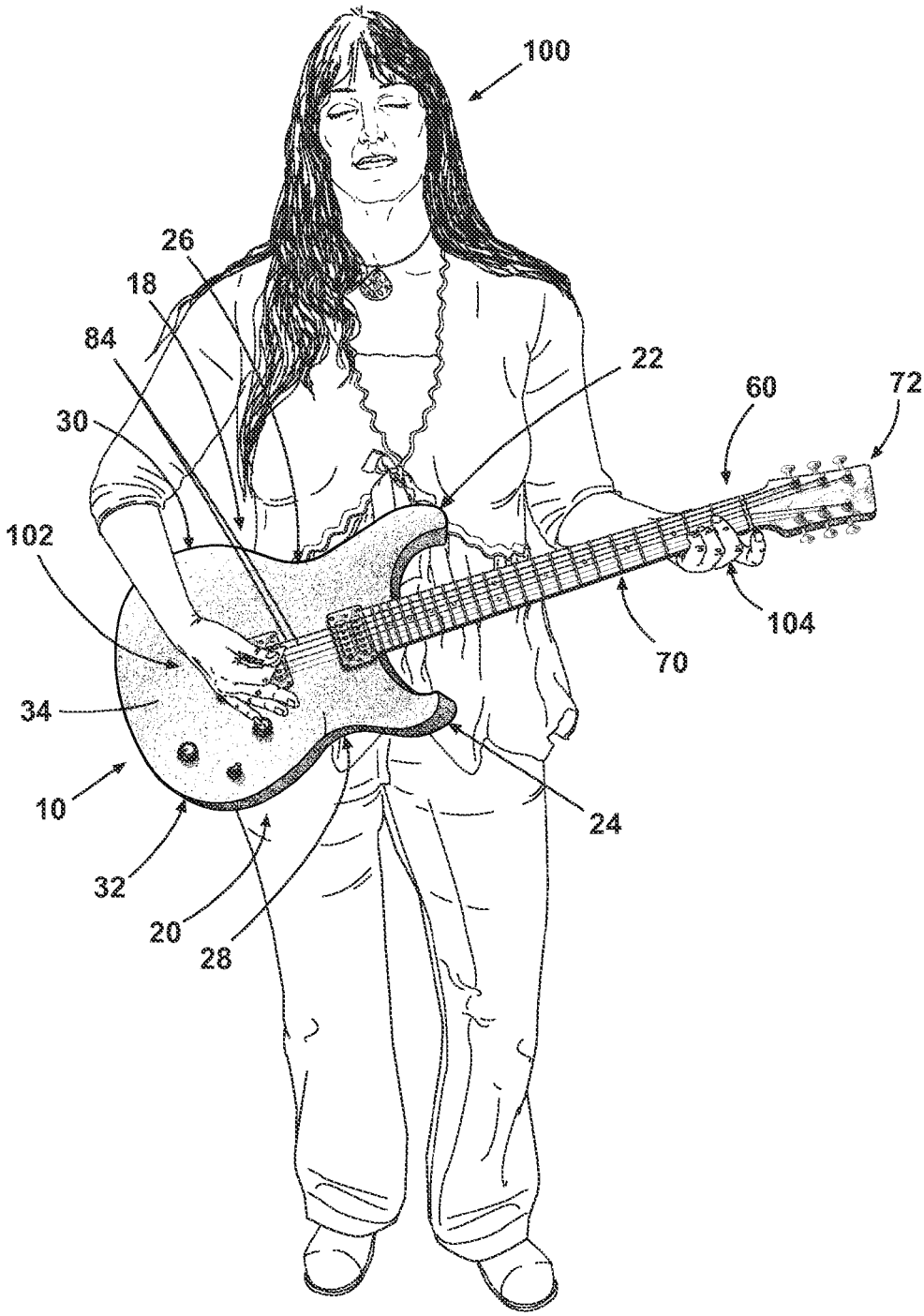
FIG. 10 is a front perspective view of a user playing the guitar of FIG. 9.
Figure 11:
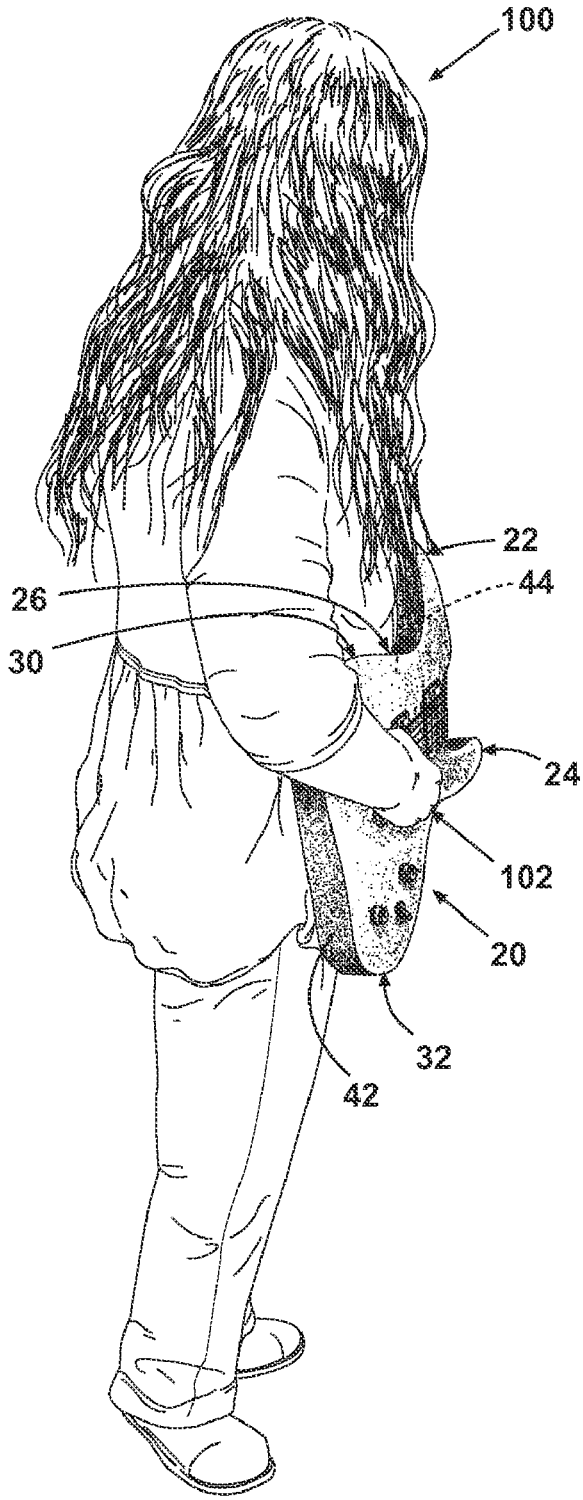
FIG. 11 is a side perspective view of a user playing the guitar of FIG. 9.
Figure 12:
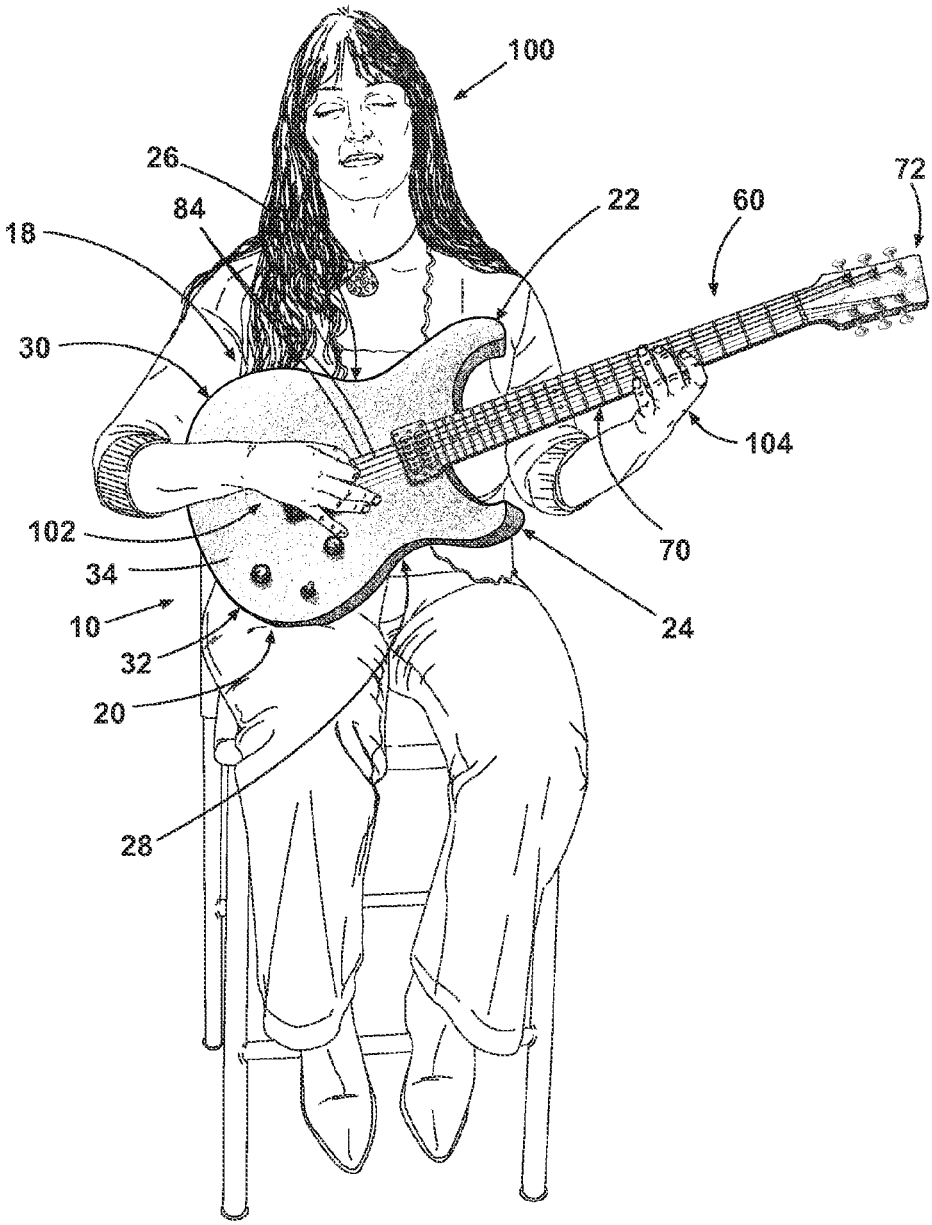
FIG. 12 is a front view of a user playing the guitar of FIG. 9.

Referring now to FIGS. 10 through 15, a user 100 is illustrated playing the guitar 60 according to a third embodiment of the invention. As illustrated in FIGS. 11 and 12, the user 100 can hold the body 10 of the guitar 60 against the user's body with a right hand 102 and support the neck 70 of the guitar 60 with a left hand 104. As is known in the art, the guitar 60 is generally held such that the first side 18 is adjacent the user's torso and the second side 20 is adjacent the user's right thigh. The user 100 can then play the guitar 60 as desired. It is within the scope of the invention for the guitar 60 to be used with additional components such as a neck strap (not shown). While the guitar 60 is illustrated for use by a right-handed user, it is within the scope of the invention for the guitar 60 to be made suitable for use by a left-handed user. A guitar suitable for use by a left-handed user can have all of the same features as the guitar 60, except that the left-handed guitar is a mirror image of the right-handed guitar 60.

Not only is the curvilinear, 3-dimensional shape of the guitar body 10 aesthetically pleasing, it provides the user 100 with a more comfortable and enjoyable playing experience. Many traditional guitars can be heavy and awkward, making extended play uncomfortable and exhausting. As described above, the first upper and lower bout regions 22 and 30 curve away from the anterior face 34 and, when held by a user as illustrated in FIGS. 10 and 11, the first upper and lower bout regions 22 and 30 curve towards the user's body. These curved regions 22 and 30 more closely fit the contour of the user's body, providing the user 100 with a more comfortable fit. The contour region 44 further facilitates the fit of the guitar body 10 to the user's body. In addition, the curve of the lower bout region 30 provides the anterior face 34 with a rounded area in the lower bout region. This rounded area provides a user with a more comfortable resting position for the user's arm while playing. Because electric guitars are typically planar, the upper edge of the guitar requires a user to extend his or her arm and elbow around the edge of the guitar in order to reach the strings in the bridge area. This can create additional stress and tension in the user's elbow and shoulder. The curved and rounded shape of the lower bout region 30 of the guitar body 10 is easier for a user to reach, resulting in less stress and tension in the user's elbow and shoulder.

The curvilinear shape of the second side 20 also provides the user with increased comfort and ease of use while playing. As described above, the second upper and lower bout regions 24 and 32 curve away from the posterior face 36 and, when held by a user as illustrated in FIGS. 10 and 11, the second upper and lower bout regions 24 and 32 curve away from the user's body, allowing the user to more comfortably hold the guitar against the user's thigh.

Figure 13:
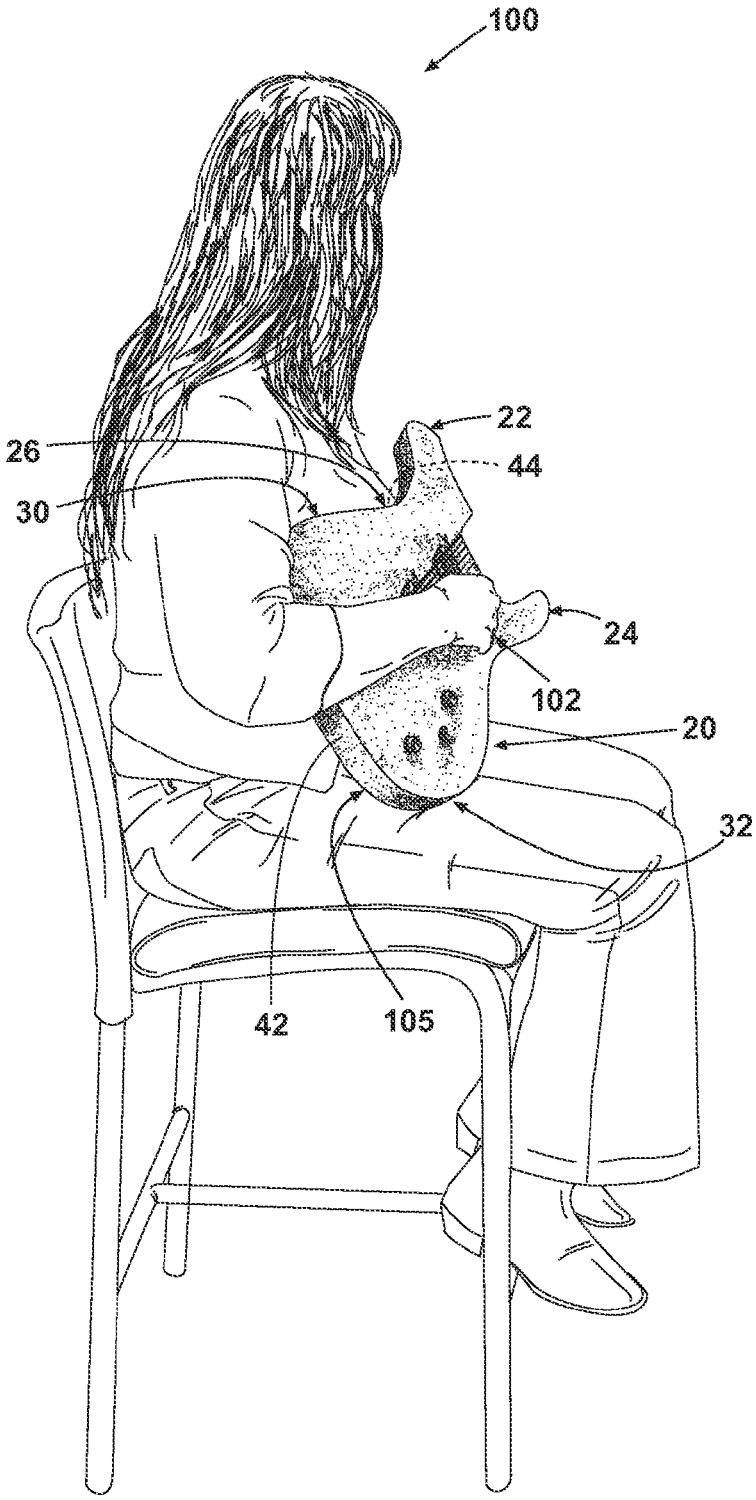
FIG. 13 is a side view of a user playing the guitar of FIG. 9.
Figure 15:
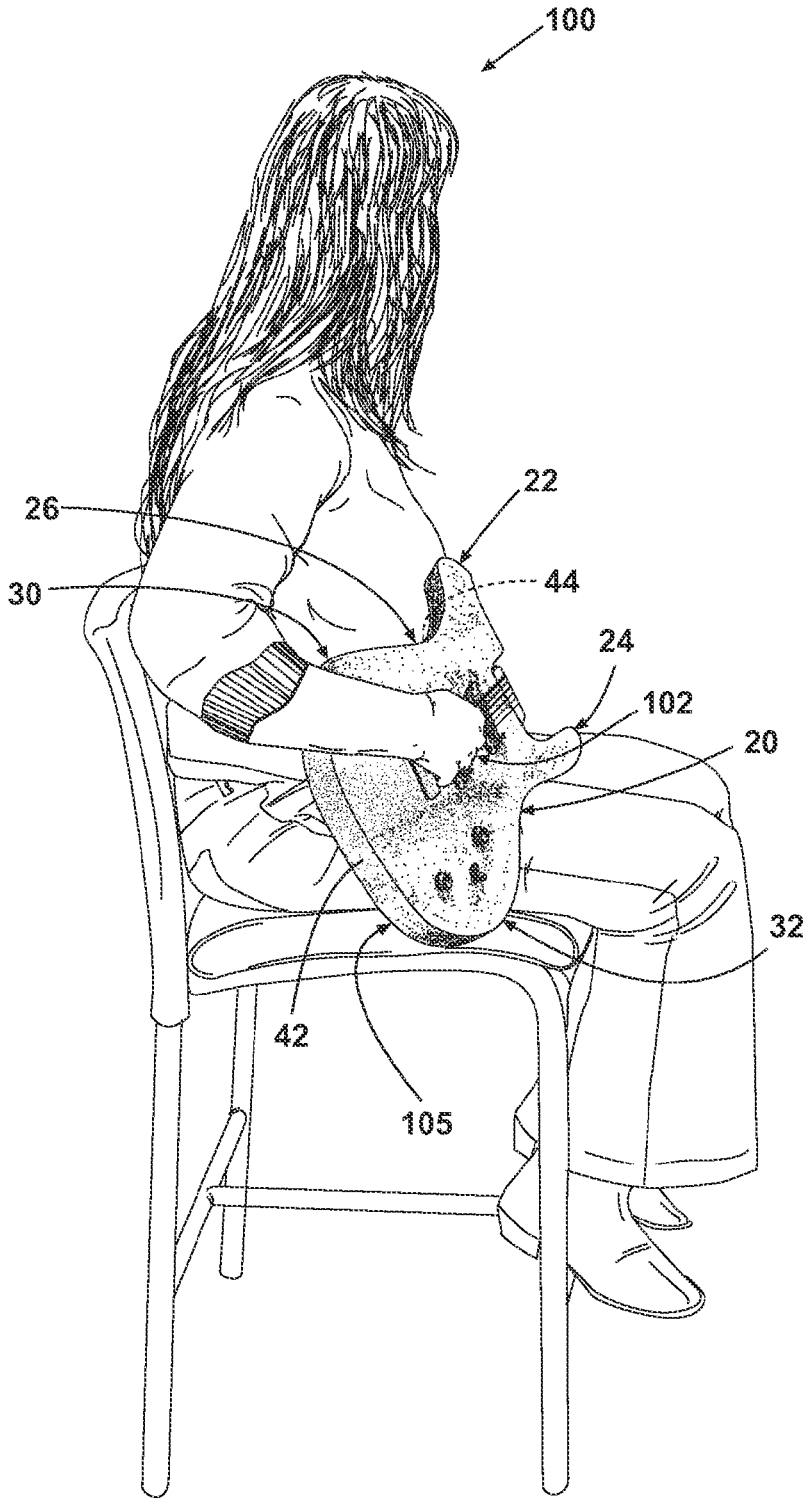
FIG. 15 is a side view of a user playing the guitar of FIG. 9.

As can best be seen in FIGS. 13 and 15, the curve of the second lower bout region 32 and second waist 28 in an anterior direction also provides an increase in surface area, as indicated by arrow 105, on the posterior face 36 in the second lower bout region 32 and second waist 28 that can engage the user's thigh. As discussed above, guitar body 10 curves away from the posterior face 36 towards the anterior face 34 along the second side 20 and the sidewall 42 along the second side 20 generally slopes away from the anterior face 34 toward the posterior face 36. The curve of the guitar body 10 and the slope of the sidewall 42 along the second side 20 provide the guitar body 10 with a posterior face 36 having an increased surface area along the second side 20 compared to a traditional planar guitar. The increase in surface area can engage the user's thigh and provide additional friction to keep the guitar body 10 from sliding down the user's thigh, thereby acting as a brake to resist sliding of the guitar body 10 on the user's thigh. The second upper bout region 24 also curves in an anterior direction, which can help to minimize interaction of the guitar 60 with the user's adjacent leg, which can be uncomfortable. This can be particularly advantageous when a user is playing the guitar while sitting in a chair or on a stool. Traditional planar guitars have a tendency to constantly slip and slide down a user's thigh while sitting due to the minimal amount of surface area available to engage the user's thigh. The planar nature of traditional guitar bodies, provide only an edge of the guitar where the posterior face and sidewall meet to engage the user's thigh. Maintaining the balance of the guitar at the desired location on the user's thigh can be difficult using only an edge, contributing to the slippage of the guitar body on the user's thigh. The constant readjustment of the guitar against the user's thigh can become annoying and tiring, especially during long periods of play.

Figure 14:
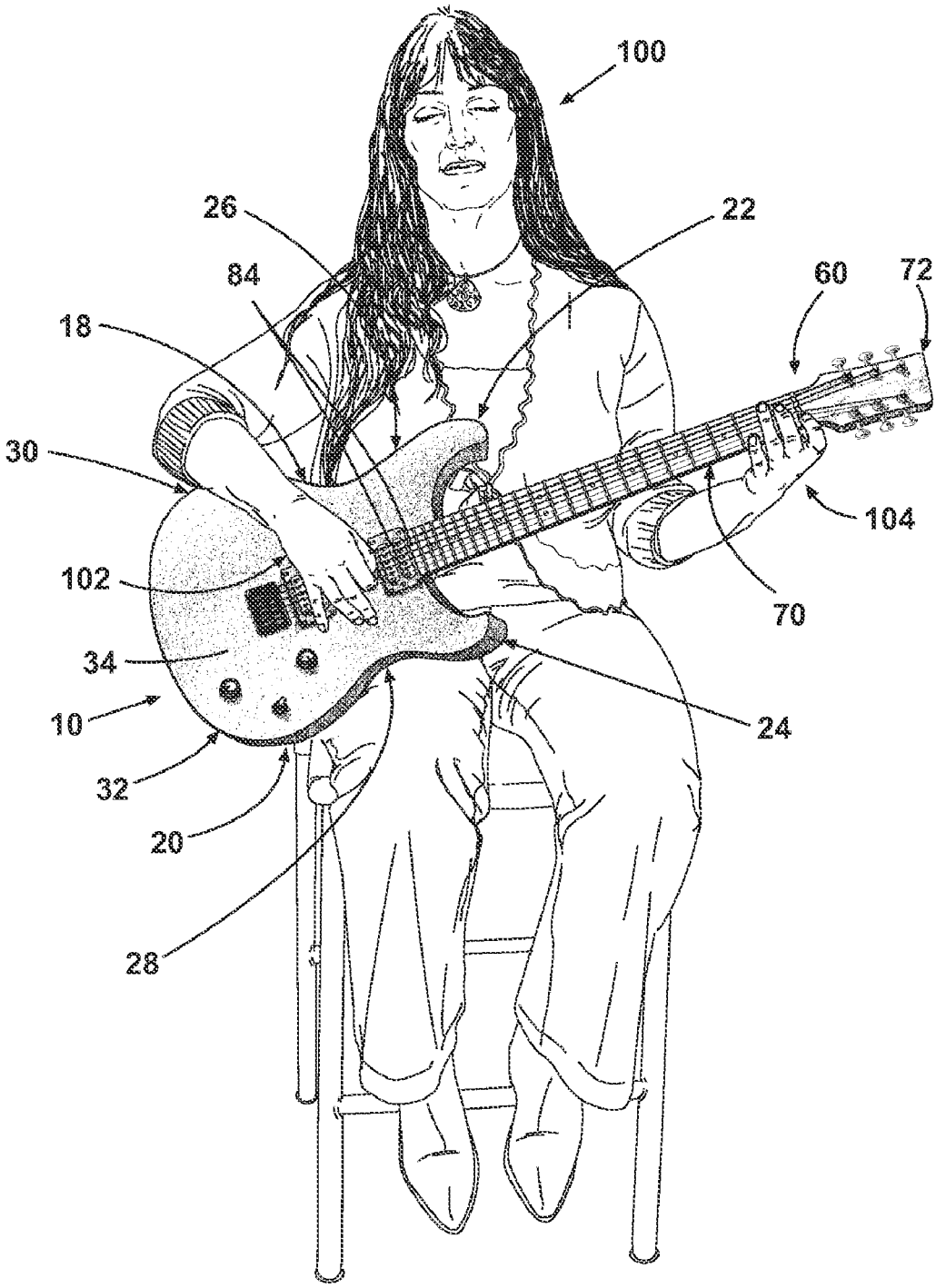
FIG. 14 is a front view of a user playing the guitar of FIG. 9.

In addition, when the guitar 60 is held as illustrated in FIGS. 14 and 15 such that the second waist 28 is adjacent the user's thigh, the compound curves of the second side 20 and the curve of the guitar body 20 in an anterior direction along the length of the second side 20 provide a comfortable fit against the user's thigh.

While the guitar body 10 is illustrated as having generally the entire length of the second side 20 curve and extend laterally and anteriorly with respect to the guitar body 10, it is also within the scope of the invention for only a portion of the second side 20 to curve laterally and anteriorly. It is also within the scope of the invention for the degree of curve or extension of the second side 20 to vary along the length of the second side 20. For example, the second lower bout region 32 can curve and extend laterally and anteriorly with respect to the guitar body 10 to a greater degree than the second upper bout region 24.

Another benefit of the guitar body 10 is its ornamental appearance. Typically, electric guitars are planar or 2-dimensional, meaning only the cut-out shape of the perimeter is varied. This limits the variety of guitar body appearances. The guitar body 10 as described herein is designed in all 3-dimensions, providing an additional dimension in which the aesthetic of the guitar can be designed.

Yet another benefit of the guitar body 10 is the method in which it is made. Because the body 10 is shaped instead of machined, the curves can be adjusted accordingly to fit the individual needs of the user. In addition, because the guitar body 10 is curvilinear and 3-dimensional rather than flat and planar, the guitar body 10 can be made thinner while still appearing to be of a suitable, substantial size to provide a desired appearance. This decreases the overall weight of the guitar, which can improve the comfort and ease of use of the guitar, especially during periods of extend playing.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A guitar body comprising:

an upper bout region and a lower bout region;

a waist region disposed between the upper and lower bout regions;

a first peripheral edge of the guitar body defined generally in a longitudinal direction thereof by a first upper bout region, a first waist region, and a first lower bout region and a second peripheral edge of the guitar body defined generally in the longitudinal direction thereof by a second upper bout region, a second waist region, and a second lower bout region, whereby an anterior face and a posterior face of the guitar body extend between the first and second peripheral edges thereof; and wherein at least one of the anterior face and the posterior face includes at least one curve so that at least a portion of the first peripheral edge includes at least one curve so that at least a portion of the first peripheral edge of the guitar body is not co-planar with at least a portion of the second peripheral edge of the guitar body.

2. The guitar body of claim 1 wherein the first upper bout region and the first lower bout region are disposed posteriorly of the first waist region thereby creating a recessed area on the posterior face of the guitar body.

3. The guitar body of claim 2 wherein the anterior face curves generally parallel with the recessed area of the posterior face of the guitar body.

4. The guitar body of claim 2 wherein the first peripheral edge is disposed posteriorly of the second peripheral edge of the guitar body.

5. The guitar body of claim 1 wherein the anterior face slopes toward the first peripheral edge adjacent thereto.

6. The guitar body of claim 1 wherein the second peripheral edge includes at least one portion that extends laterally and anteriorly with respect to the guitar body.

7. The guitar body of claim 6 wherein the entire length of the second peripheral edge extends laterally and anteriorly with respect to the guitar body, thereby forming a brake that resists sliding against a surface on which the guitar body is rested.

8. The guitar body of claim 1 wherein the first upper bout region, the first waist region and the first lower bout region cooperate to form a generally U-shaped region on the posterior face of the guitar body.

9. The guitar body of claim 1 wherein the second upper bout region, the second waist region and the second lower bout region cooperate to form a generally U-shaped region on the posterior face of the guitar body.

10. The guitar body of claim 1 wherein the first upper bout region and the second upper bout region cooperate to form a generally S-shaped region between the posterior and the anterior faces of the guitar body.

11. The guitar body of claim 1 wherein the first lower bout region and the second lower bout region cooperate to form a generally S-shaped region between the posterior and the anterior faces of the guitar body.

12. The guitar body of claim 1 wherein the anterior face of the first lower bout portion slopes posteriorly adjacent a longitudinal end thereof.

13. The guitar body of claim 1 wherein at least a portion of the first peripheral edge is offset posteriorly and at least a portion of the second peripheral edge is offset anteriorly.

14. The guitar body of claim 1 wherein the guitar body has a neck attachment region located in the upper bout region adapted to have a guitar neck mounted thereto so that strings can be provided along the neck and the anterior face of the guitar body.

15. The guitar body of claim 1 wherein the anterior face of the guitar body has a bridge provided thereon.

16. The guitar body of claim 1 wherein the posterior face of the guitar body has a recessed area adapted to receive electronic equipment therein.

17. The guitar body of claim 1 wherein the guitar body is made from compression molding of laminated plies of a lightweight wood.

18. A guitar body comprising:

an upper bout region and a lower bout region;

a waist region disposed between the upper and lower bout regions;

a first peripheral edge of the guitar body defined generally in a longitudinal direction thereof by a first upper bout region, a first waist region, and a first lower bout region and a second peripheral edge of the guitar body defined generally in the longitudinal direction thereof by a second upper bout region, a second waist region, and a second lower bout region, whereby an anterior face and a posterior face of the guitar body extend between the first and second peripheral edges thereof; and wherein at least a portion of the first peripheral edge is offset posteriorly and at least a portion of the second peripheral edge is offset anteriorly.

19. The guitar body of claim 18 wherein the first upper bout region and the first lower bout region are disposed posteriorly of the first waist region thereby creating a recessed area on the posterior face of the guitar body.

20. The guitar body of claim 19 wherein the anterior face curves generally parallel with the recessed area of the posterior face of the guitar body.

21. The guitar body of claim 18 wherein the anterior face slopes toward the first peripheral edge adjacent thereto.

22. The guitar body of claim 18 wherein the entire length of the second peripheral edge extends laterally and anteriorly with respect to the guitar body, thereby forming a brake that resists sliding against a surface on which the guitar body is rested.

23. The guitar body of claim 18 wherein the first upper bout portion, the first waist region and the first lower bout region cooperate to form a generally U-shaped region on the posterior face of the guitar body.

24. The guitar body of claim 18 wherein the second upper bout region, the second waist region and the second lower bout region cooperate to form a generally U-shaped region on the posterior face of the guitar body.

25. The guitar body of claim 18 wherein the first upper bout region and the second upper bout region cooperate to form a generally S-shaped region between the posterior and the anterior faces of the guitar body.

26. The guitar body of claim 18 wherein the first lower bout region and the second lower region portion cooperate to form a generally S-shaped region between the posterior and the anterior faces of the guitar body.

27. The guitar body of claim 18 wherein the anterior face of the first lower bout portion slopes posteriorly adjacent a longitudinal end thereof.

28. The guitar body of claim 18 wherein at least one of the anterior face and the posterior face includes at least one curve so that at least a portion of the first peripheral edge includes at least one curve so that at least a portion of the first peripheral edge of the guitar body is not co-planar with at least a portion of the second peripheral edge of the guitar body.

29. The guitar body of claim 18 wherein the guitar body has a neck attachment region located in the upper bout region adapted to have a guitar neck mounted thereto so that strings can be provided along the neck and the anterior face of the guitar body.

30. The guitar body of claim 18 wherein the anterior face of the guitar body has a bridge provided thereon.

31. The guitar body of claim 18 wherein the posterior face of the guitar body has a recessed area adapted to receive electronic equipment therein.

32. The guitar body of claim 18 wherein the guitar body is made from compression molding of laminated plies of a lightweight wood.

* * * * *